US007540231B2

(12) United States Patent
Hofmann et al.

(10) Patent No.: US 7,540,231 B2
(45) Date of Patent: Jun. 2, 2009

(54) CONTROL VALVE DEVICE FOR THE CONTROL OF A CONSUMER

(75) Inventors: Richard Hofmann, Alzenau (DE); Edmund Kraft, Karlstadt (DE)

(73) Assignee: Linde Material Handling GmbH, Aschaffenburg (DE)

( * ) Notice: Subject to any disclaimer, the term of this patent is extended or adjusted under 35 U.S.C. 154(b) by 201 days.

(21) Appl. No.: 11/637,235

(22) Filed: Dec. 11, 2006

(65) Prior Publication Data

US 2007/0144164 A1 Jun. 28, 2007

(30) Foreign Application Priority Data

Dec. 12, 2005 (DE) ..... 10 2005 059 238

(51) Int. Cl.
*F15B 13/04* (2006.01)

(52) U.S. Cl. ..... 91/436

(58) Field of Classification Search ..... 91/420, 91/436, 437, 440
See application file for complete search history.

(56) References Cited

U.S. PATENT DOCUMENTS 4,152,970 A * 5/1979 Hall et al. ..... 91/436
4,836,088 A * 6/1989 Seabaugh ..... 91/436
5,826,486 A * 10/1998 Shimada ..... 91/436

FOREIGN PATENT DOCUMENTS

DE 198 44 669 A1 3/2000

* cited by examiner

*Primary Examiner*—Michael Leslie
(74) *Attorney, Agent, or Firm*—The Webb Law Firm

(57) ABSTRACT

A control valve device (1) for the control of a dual-action consumer (2) has a control valve (3) that controls the connection of a pressure fluid line (6*a*) that forms the admission side of the consumer (2) with a pump and an additional pressure fluid line (6*b*) that forms the return side of the consumer (2) with a reservoir. A regeneration function allows the return side of the consumer (2) to be connected with the admission side of the consumer (2). The regeneration function has a short circuit device (10) located between the consumer (2) and the control valve (3). For the regeneration function, the connection of the additional pressure fluid line (6*b*) that forms the return side of the consumer (2) with the reservoir can be blocked by a shutoff valve device (20) located between the consumer (2) and the control valve (3).

23 Claims, 1 Drawing Sheet

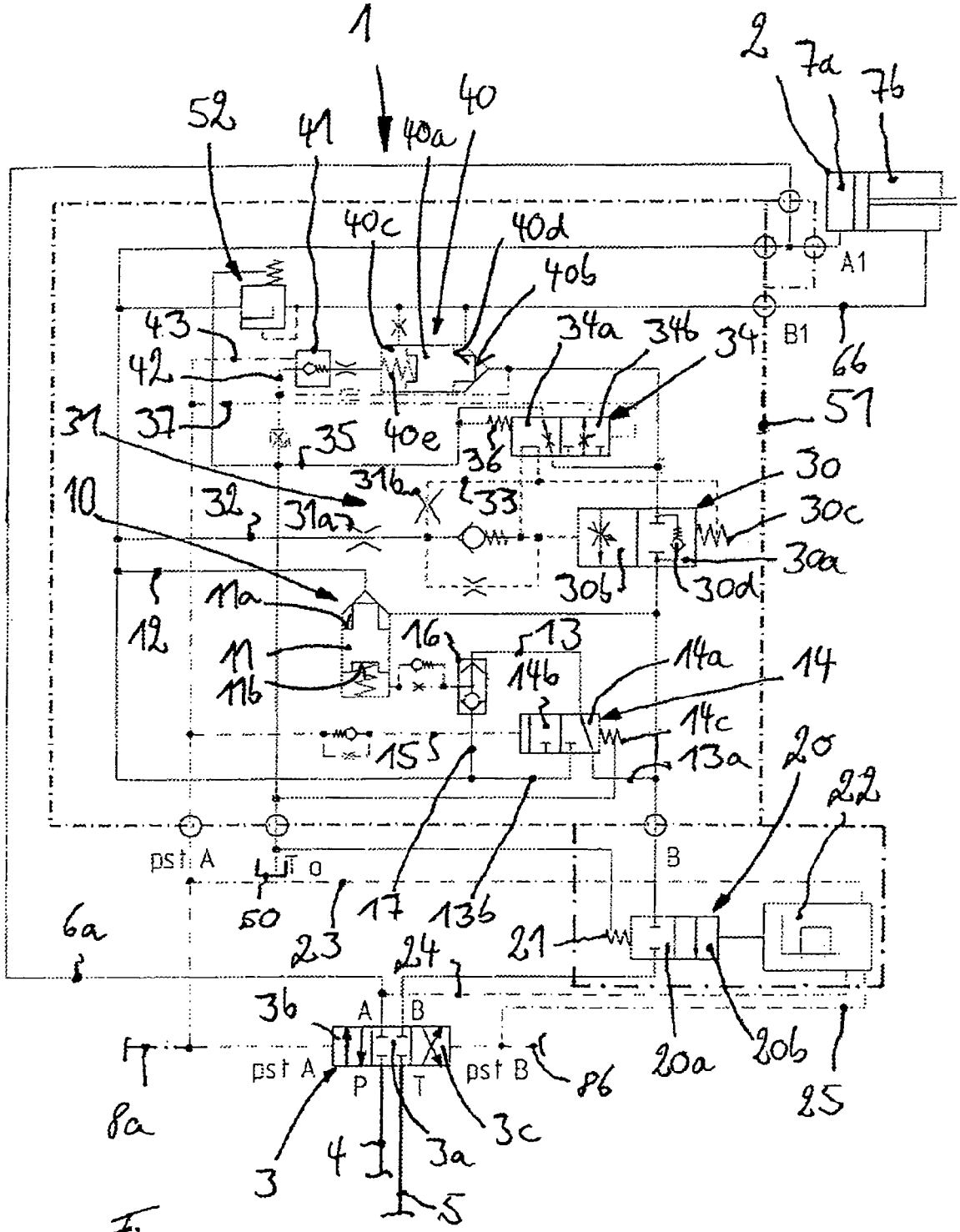
Fig.

CONTROL VALVE DEVICE FOR THE CONTROL OF A CONSUMER

CROSS REFERENCE TO RELATED APPLICATION

This application claims priority to German Application No. 10 2005 059 238.4, filed Dec. 12, 2005, which application is herein incorporated by reference in its entirety.

BACKGROUND OF THE INVENTION

1. Field of the Invention

This invention relates to a control valve device for the control of a consumer, such as a dual-action consumer. The control valve device has a control valve that controls the connection of a pressure fluid line that forms the connection of the admission side of the consumer with a pump and an additional pressure fluid line that forms the return side of the consumer with a reservoir. The control valve device has a regeneration function by means of which the return side of the consumer can be connected with the admission side of the consumer.

2. Technical Considerations

Control valve devices are used for the control of consumers in mobile machines, for example to control a stick cylinder of an excavator. To prevent cavitation on the admission side of the consumer and to achieve an increased speed of movement of the consumer that requires a flow that exceeds the discharge flow delivered by the pump, control valve devices are provided with a regeneration function. The regeneration function connects the return side of the consumer with the admission side. As a result of which, on the admission side of the consumer, the flow of pressure fluid flowing out of the return side of the consumer is available in addition to the discharge flow delivered by the pump.

A control valve device is described in DE 198 44 699 A1. The regeneration function is formed by regeneration lines, each of which connects a return line that leads from the control valve to the reservoir with the respective admission side of the consumer. Check valves that open to the admission side of the consumer are located in these regeneration lines. For the regeneration function, the return line is shut off by means of a valve device located in the return line downstream of the connections of the regeneration lines. When the regeneration function is active, the pressure fluid that is being discharged from the return side of the consumer flows via the control valve and the return line (which is shut off by means of the valve device) into the regeneration line (which is in communication with the admission side of the consumer) and thus to the admission side of the consumer. However, as a result of this routing of the flow of pressure fluid of the regeneration function via the control valve, long flow paths are required. This leads to high line losses and thus to a low efficiency of the regeneration function. On account of the regeneration lines, the regeneration function also requires a great deal of construction effort and expense. Moreover, with a regeneration function of this type not all of the pressure fluid that is discharged from the return side can be transported to the admission side. This means that only a limited increase in the speed of the consumer can be achieved in the regeneration function.

Therefore, it is an object of this invention to provide a control valve device of the general type described above but that makes possible a regeneration function with an improved increase in the speed of the consumer and low line losses and therefore high efficiency.

SUMMARY OF THE INVENTION

The invention teaches that the regeneration function (regeneration device) has a short circuit device located between the consumer and the control valve. This makes it possible to connect the pressure fluid line that forms the return side of the consumer with the pressure fluid line that forms the admission side of the consumer. For the regeneration function, the connection between the pressure fluid line that forms the return side of the consumer and the reservoir can be shut off by means of a shutoff valve located between the consumer and the control valve. The invention therefore teaches a short circuit device located between the consumer and the control valve and, for the regeneration function, connects the return side with the admission side of the consumer. The invention further teaches that the connection of the return side of the consumer with the reservoir can be shut off by means of a shutoff valve located in the return side between the consumer and the control valve. When the regeneration function is active, the connection of the return side of the consumer with the reservoir can be completely shut off by the control valve, whereby all of the pressure fluid being discharged from the return side of the consumer flows via the short circuit device, bypassing the control valve, directly into the admission side of the consumer. Consequently, for the regeneration function, a short flow path of the pressure fluid from the return side to the admission side of the consumer can be achieved. As a result of which, the line losses are low and a high level of efficiency can be achieved. As a result of the presence of the short circuit device, it also becomes possible to achieve a simple routing of the conduits with little construction effort and expense. As a result of the complete shutoff of the connection between the return side of the consumer and the reservoir by the shutoff valve, all of the pressure fluid that is discharged from the return side of the consumer can be transported to the admission side. As a result of which, in the regeneration function, a doubling of the speed of movement of the consumer and thus a greater increase in the speed of the consumer can be achieved with low line losses and thus with high efficiency.

In one preferred embodiment of the invention, the shutoff valve device is realized in the form of a control valve with a shutoff position and an open position. With a shutoff valve device of this type, the return side of the consumer can be shut off in a simple manner for the regeneration function.

It is particularly advantageous if the control valve can be actuated by a first control signal toward a position that connects the pressure medium line with the pump; actuates the control valve to a position that connects the additional pressure fluid line with the reservoir; actuates the shutoff valve into the shutoff position and, as a function of the admission pressure available at the pressure fluid line that forms the admission side of the consumer, actuates the control valve toward the open position. The regeneration function can be overridden by an actuation of the shutoff valve device toward the open position as a function of the admission pressure that is available on the admission side of the consumer. Under operating conditions in which a high admission pressure at the consumer is necessary to achieve high power or increased performance, the regeneration function can be deactivated in a simple manner by the overriding of the regeneration function as a function of the admission pressure. By means of the overriding of the regeneration function as a function of the admission pressure, it thereby becomes possible in a simple manner to ensure that the regeneration function is active only to achieve an increased speed of movement of the consumer.

If, as in one preferred development of the invention, the shutoff valve device can be actuated toward the open position as a function of a second control signal of the control valve that actuates the control valve toward a position that connects the additional pressure fluid line with the pump and the pressure fluid line with the reservoir, the shutoff valve device can be actuated in a simple manner into the flow position to achieve an unobstructed flow of pressure fluid from the pump to the consumer when the control valve is actuated toward the second position.

The shutoff valve device can be advantageously actuated toward the shutoff position by means of a spring.

In one advantageous configuration of the invention, the short circuit device can be realized in the form of a short circuit valve located in a connecting line that connects the additional pressure fluid line with the pressure fluid line. The short circuit valve has a shutoff position and an open position and, for the regeneration function, can be actuated toward the open position as a function of the first control signal of the control valve. With a short circuit valve of this type, it is possible in a simple manner, for the regeneration function, to establish a connection between the return side of the consumer and the admission side with short flow paths. As a result of the actuation of the short circuit valve as a function of the first control signal of the control valve, the short circuit valve can be actuated in a simple manner for the regeneration function from the shutoff position into the open position.

The short circuit valve can be realized in the form of a slide valve with an open position and a shutoff position, and can be actuated toward the shutoff position by means of a spring and toward the open position as a function of the control signal of the control valve.

With regard to a simple construction that requires little effort and expense, it is advantageous if the short circuit valve is realized in the form of a spring-loaded seat valve that is provided with a first control pressure surface that acts toward an open position. The control surface is actuated by the pressure available in the additional pressure fluid line. A short circuit valve realized in the form of a seat valve has a low flow resistance in the open position, as a result of which the regeneration function has high efficiency.

The short circuit valve is advantageously provided with a second control surface that acts toward a shutoff position and can be actuated by the pressure available in the additional pressure fluid line and, for the regeneration function, can be discharged of the pressure available in the additional pressure fluid line. It thereby becomes possible in a simple manner to actuate the short circuit valve into the open position by the discharge of the second control pressure surface from the return pressure present in the additional pressure fluid line for the regeneration function by the return pressure present at the first control surface.

A pilot control valve is advantageously provided for the control of the actuation of the second control pressure surface.

In one preferred configuration of the invention, the pilot valve has a first position in which the second control pressure surface is in communication with the additional pressure fluid line, and a second position in which the second control pressure surface is in communication with the pressure fluid line. The pilot control valve can be actuated as a function of the first control signal of the control valve toward the second position. For the regeneration function the pilot control valve is actuated by the first control signal of the control valve into the second position, in which the second control pressure surface of the short circuit valve is relieved of the return pressure available in the additional pressure fluid line, and is actuated by the admission pressure that is present in the pressure fluid line. It can thereby be ensured in a simple manner that the short circuit valve is actuated into the open position for the regeneration function when the return pressure present on the first control pressure surface exceeds the admission pressure present on the second control pressure surface so that the pressure fluid flowing out of the return side of the consumer flows to the admission side.

The pilot control valve can advantageously be actuated toward the first position by means of a spring.

The second control pressure surface can advantageously be actuated by the pressure that is present in the pressure fluid line. Consequently, it can be ensured in a simple manner that the second control surface of the short circuit valve, under operating conditions in which no regeneration function is necessary, is in communication with the pressure fluid line and via the pilot valve actuated into the first position with the additional pressure fluid line, and is thus actuated reliably into the shutoff position by the higher pressure present in the pressure fluid line or in the additional pressure fluid line.

For this purpose, a shuttle valve device is advantageously located between the pilot control valve and the second control pressure surface, whereby a first input of the shuttle valve device is in communication with the output of the pilot control valve, a second input of the shuttle valve device is in communication with the pressure fluid line, and an output of the shuttle valve device is in communication with the second control pressure surface. With a shuttle valve device of this type, it is possible in a simple manner to create a situation in which the actuation of the second control surface of the control valve can be controlled and can be activated by the admission pressure that is present in the pressure fluid line.

In one preferred development of the invention, a brake valve device is associated with the additional pressure fluid line that forms the return side of the consumer, upstream of the short circuit device. With a brake valve device of this type, it is possible in a simple manner to prevent an uncontrolled start of the movement of the consumer and the running of the consumer at an excessive speed.

In one advantageous configuration of the invention, the brake valve device has a shutoff position and an open position. A pressure divider circuit that is in communication with the pressure fluid line is provided for the control of the brake valve device. With a pressure divider circuit that is actuated by the admission pressure present in the pressure fluid line, it becomes possible to achieve a simple control of the brake valve device with little construction effort and expense.

The pressure divider circuit advantageously has a control pressure line that leads to a control surface of the brake valve device that acts toward the open position and is in communication with the pressure fluid line. A choke device is located in the control pressure line. Downstream of the choke device, an additional control pressure line is connected that leads to a control surface of the brake valve device, that acts toward the shutoff position. An additional choke device is located in the additional control pressure line. With a construction of the pressure divider circuit of this type, it becomes possible in a simple manner to actuate the brake valve device toward the open position by the pressure differential produced on the choke devices of the pressure divider circuit.

It is particularly advantageous if, for the control of the pressure divider circuit, a pilot control valve is provided, by means of which the connection of the additional control pressure line with a reservoir can be controlled. With a control valve, the pressure divider circuit can be controlled by the connection of the additional control pressure line with the reservoir and, thus, the actuation of the brake valve device toward the open position can be controlled.

The pilot control valve advantageously has a first position in which the connection of the additional control pressure line to the reservoir is shut off and a second position in which the additional control pressure line is connected with the reservoir. The pilot control valve can be actuated by the first control signal of the control valve toward the second position. With the pilot control valve actuated into the first position, the connection of the additional control pressure line with the reservoir is therefore shut off. As a result of which, the brake valve device is actuated into the shutoff position. When the pilot control valve is actuated by the first control signal of the control valve into the second position, the additional control pressure line is connected with the reservoir. As a result of which, the brake valve device can be actuated by means of the pressure differential generated by the pressure divider circuit toward the open position.

The pilot control valve can thereby be actuated by means of a spring toward the first position.

In one advantageous development of the invention, a load holding valve is associated with the pressure fluid line that forms the return side of the consumer, in particular upstream of the brake valve device. A load holding valve makes it possible in a simple manner to achieve a leak-free shutoff of the consumer.

In one advantageous configuration of the invention, the load holding valve is realized in the form of a pilot-operated seat valve, in particular a seat valve that can be operated by means of a pilot control valve and can be actuated as a function of the first control signal of the control valve toward an open position. A seat valve of this type can be actuated in a simple manner by the pilot control valve controlled by the first control signal for the opening of the additional pressure line that forms the return side of the consumer.

If in the first position of the pilot control valve of the pressure divider circuit the additional pressure fluid line that forms the return side of the consumer is discharged upstream of the brake valve to the reservoir, it is possible in a simple manner to ensure that the return side is discharged to the reservoir between the load holding valve and the brake valve device in the neutral position of the control valve and, thus, the load holding valve is reliably actuated into the shutoff position.

If in the second position of the pilot control valve of the pressure divider circuit the connection of the additional pressure fluid line that forms the return side with the reservoir is shut off, it is possible in a simple manner to prevent an uncontrolled discharge of pressure fluid from the return side of the consumer to the reservoir and, thereby, ensure that the return side can be controlled by means of the brake valve device.

In one development of the invention, to protect the pressure fluid line that forms the return side of the consumer, a pressure limiting device is provided, such as a pressure limiting device located in the pressure fluid line that forms the return side of the consumer upstream of the load holding valve. As a result of which, it is possible in a simple manner to provide protection for the return side of the consumer.

With regard to low power losses and a short flow path of the pressure fluid that flows from the return side to the admission side for the regeneration function, it is advantageous if the short circuit device and/or the pilot control valve of the short circuit device and/or the brake valve device and/or the pilot control valve of the pressure divider circuit and/or the load holding valve and/or the pressure limiting device and/or the shutoff valve device is/are located on the consumer. As a result of the location of these valves separately from the control valve directly on the consumer, in particular on the admission side of the consumer, it becomes easily possible to retrofit a regeneration function as well as a brake valve device and a load holding valve of the invention on an existing control valve.

Particular advantages are achieved with the realization of the consumer in the form of a stick cylinder of an excavator. With the regeneration function of the invention, a regeneration function can be achieved on a stick cylinder with a high increase of the speed of movement of the stick cylinder and thus of the stick with little construction effort and expense, with low line losses and thus with high efficiency. It also becomes possible to prevent cavitation on the admission side of the stick cylinder. As a result of the overriding of the regeneration function by the admission pressure of the stick cylinder, it becomes easily possible to deactivate the regeneration function under operating conditions in which a high admission pressure is required to achieve high digging forces.

BRIEF DESCRIPTION OF THE DRAWING

Additional advantages and features of the invention are explained in greater detail below on the basis of the exemplary embodiment illustrated in the accompanying schematic FIGURE showing a control valve device of the invention.

DESCRIPTION OF THE PREFERRED EMBODIMENT

The FIGURE shows a schematic diagram of a control valve device 1 of the invention for the control of a dual-action consumer 2, for example of a stick cylinder that activates a stick of an excavator.

The control valve device 1 comprises a control valve 3 connected to a delivery line 4 of a pump (which is not shown in any further detail) and to a reservoir line 5 that leads to a reservoir (that is likewise not shown in any further detail).

The control valve 3 is also connected to a pressure fluid line 6*a* that is connected with a piston-side compression chamber 7*a* of the consumer 2 and to an additional pressure fluid line 6*b* which is connected with a compression chamber 7*b* on the piston-rod side of the consumer 2.

In the illustrated neutral position 3*a* of the control valve 3, the pressure fluid lines 6*a*, 6*b*, the delivery line 4, and the reservoir line 5 are shut off. In a normal position 3*b*, the delivery line 4 is connected with the first pressure fluid line 6*a* and the pressure fluid line 6*b* is connected with the reservoir line 5. In the normal position 3*b*, the compression chamber 7*a* therefore forms the admission side of the consumer 2 and the piston-rod side compression chamber 7*b* of the consumer forms the return side of the consumer 2. In an additional position 3*c* of the control valve 3, the delivery line 4 is connected with the second pressure fluid line 6*b* and the first pressure fluid line 6*a* is connected with the reservoir line 5. In the position 3*c*, the piston-rod-side compression chamber 7*b* of the consumer 2 forms the admission side and the compression chamber 7*a* forms the return side of the consumer 2.

The control valve 3 is realized in the form of a control rod that performs a throttling action in intermediate positions and is actuated into the neutral position 3*a* by means of springs that are not shown in any further detail. The control valve 3 is actuated toward the position 3*b* by a control signal, for example by a hydraulic control pressure, that is transmitted in a control pressure line 8*a*. The control valve 3 can be actuated toward the additional position 3*c* by an additional control signal, such as an additional control pressure, for example, which is transmitted in a control pressure line 8*b*.

The invention teaches that the control valve device 1 is provided with a regeneration function which, under operating conditions in which the pressure fluid line 6*a* is in connection with the piston-side compression chamber 7*a* of the consumer 2 that forms the admission side of the consumer 2, and the additional pressure fluid line 6*b* is in communication with the piston-rod-side compression chamber 7*b* that forms the return side of the consumer 2, makes possible a connection of the return side with the admission side when the control valve 3 is actuated toward the position 3*b* by the first control signal.

The regeneration function comprises a short circuit device 10 located between the control valve 3 and the consumer 2 and is formed by a short circuit valve 11 realized in the form of a spring-loaded seat valve which is provided with a shutoff position and an open position. The short circuit valve 11 is located in a connecting line 12 that connects the pressure fluid line 6*a* with the additional pressure fluid line 6*b* and thus connects the return side with the admission side of the consumer 2.

The short circuit valve 11 has a first control pressure surface 11*a* that actuates the valve toward an open position, and can be actuated via the connecting line 12 with the additional pressure fluid line 6*b* and thus for the regeneration function with the return pressure present in the pressure fluid line 6*b*.

In a spring chamber of the short circuit valve 11 that acts toward the shutoff position, a second control pressure surface 11*b* is realized which is actuated by the return pressure in the additional pressure fluid line 6*b* and thus on the return side, and can be discharged of the return pressure for the regeneration function. For this purpose, a control pressure line 13 is provided in which a pilot control valve 14 is located.

The pilot control valve 14 has a first position 14*a* in which the control pressure line 13 is connected to a control pressure line 13*a* which is in communication with the additional pressure fluid line 6*b*. Thus, the second control pressure surface 11*b* is in communication with the additional pressure fluid line 6*b* and thus the return side of the consumer 2. In a second position 14*b* of the pilot control valve 14, the control pressure line 13 is connected to a control pressure line 13*b* which is in communication with the pressure fluid line 6*a* and thus with the admission side of the consumer 2. The pilot control valve 14 is actuated by means of a spring 14*c* toward the first position 14*a*. The pilot control valve 14 can be actuated toward the second position 14*b* by the first control signal of the control valve 3. For this purpose, a control surface of the pilot control valve 14 that acts toward the second position 14*b* is connected with a control pressure branch line 15 which is in communication with the first control pressure line 8*a*.

The second control pressure surface 11*b* of the short circuit valve 11 can also be actuated by the pressure present in the pressure fluid line 6*a*. For this purpose, a shuttle valve 16 is provided which has a first input which is in communication with the control pressure line 13 and, thus, with the output of the pilot control valve 14. A second input of the shuttle valve device 16 is in communication with a control pressure line 17, which is connected to the control pressure line 13*b* and is thus in communication with the first pressure fluid line 6*a*. The output of the shuttle valve device 16 is in communication with the spring chamber and thus with the second control pressure surface 11*b* of the short circuit valve 11.

By means of the pilot control valve 14, for the regeneration function, the second control pressure surface 11*b* of the short circuit valve 11 can therefore be discharged as a function of the first control signal of the control valve by the return pressure present in the additional pressure fluid line 6*b* by an actuation into the second position 14*b*, and can be actuated by the admission pressure present in the first pressure fluid line 6*a* and thus the short circuit valve 11 can be actuated toward the open position as a function of the first control signal of the control valve 3.

The regeneration function also has a shutoff valve device 20 which is located in the additional pressure fluid line 6*b* that forms the return side downstream of the connection of the connecting line 12 that is provided with the short circuit device 10.

The shutoff valve device 20 is realized in the form of a control valve with a shutoff position 20*a* and an open position 20*b*. The shutoff valve device 20 is actuated by means of a spring 21 toward the shutoff position 20*a*. The shutoff valve device 20 is actuated toward the open position 20*b* as a function of the first control signal that actuates the control valve 3 toward the position 3*b* and as a function of the resulting admission pressure present in the pressure fluid line 6*a* and thus at the admission side of the consumer can be actuated toward the open position 20*b*. For this purpose, an electronic control device 22 is provided which is in communication on the input side with a control pressure branch line 23 which is in communication with the first control pressure line 8*a* and with a branch line 24 that branches off from the pressure fluid line 6*a*. The shutoff valve device 20 can also be actuated toward the open position 20*b* as a function of the second control signal that actuates the control valve 3. For this purpose, the electronic control device 22 is in communication on the input side with the control pressure branch line 23 that branches off from the second control pressure line 8*b*.

When a second control signal of the control valve 3 is applied and thus when the control valve 3 is actuated toward the position 3*c*, the shutoff valve device 20 is actuated into the open position 20*b*. When the first control signal is present and thus the control valve 3 is actuated toward the position 3*b*, the shutoff valve device 20 is not actuated. If, when the first control signal is present, the admission pressure in the pressure fluid line 6*a* measured by means of the branch line 24 exceeds a specified limit value, the shutoff valve device 20 is actuated into the open position 20*b*.

In the additional pressure fluid line 6*b* that forms the return side of the consumer during the regeneration function, a brake valve device 30 is located upstream of the connection of the connecting line 12. The brake valve device 30 has a shutoff position 30*a* and an open position 30*b* and can be controlled by means of a pressure divider circuit 31 that is actuated by the admission pressure present in the pressure fluid line 6*a*. The pressure divider circuit 31 has a choke device 31*a* which is located in a control pressure line 32 that runs to a control surface that actuates the brake valve device 30 toward the open position 30*b*. The control pressure line 32 is thereby in communication with the pressure fluid line 6*a* and thus with the admission side. From the control pressure line 32, downstream of the choke device 31*a*, an additional control pressure line 33 branches off which leads to a control surface of the brake valve device 30 that acts toward the shutoff position 30*a*. An additional choke device 31*b* is located in the control pressure line 33. The brake valve device 30 can also be actuated toward the shutoff position 30*a* by means of a spring 30*c*. In the shutoff position 30*a* of the brake valve device 30 there is also a shutoff valve 30*d* that opens toward the piston-rod-side compression chamber 7*b* of the consumer 2.

For the control of the pressure divider circuit 31, a pilot control valve 34 is provided which has a first position 34*a* in which the control pressure line 32, downstream of the choke device 31*a*, and the additional control pressure line 33, downstream of the choke device 31*b*, are connected with each other. In a second position 34*b* of the pilot control valve 34, the additional pressure line 33 is connected to a reservoir line 35 that leads to a reservoir 50. The pilot control valve 34 can be actuated by means of a spring 36 toward the first position 34*a*. The pilot control valve 34 can be actuated toward the second position 34*b* as a function of the first control signal of the control valve 3. For this purpose, a control pressure branch line 37 that branches off from the first control pressure line 8*a* leads to a control surface of the pilot control valve 34 that acts toward the second position 34*b*.

When the control valve 3 is actuated by the second control signal toward the position 3*c*, the pilot control valve 34 is not actuated and is in the first position 34*a*. The brake valve device 30 is thereby actuated into the shutoff position 30*a*, whereby pressure fluid from the pump can flow into the piston-rod-side compression chamber 7*b* of the consumer 2 via the shutoff valve 30*d* which acts in the shutoff position 30*a*.

When the control valve 3 is actuated by the first control signal toward the position 3*a*, the pilot control valve 34 is actuated into the second position 34*b*, in which the additional control pressure line 33 is discharged to the reservoir 50, as a result of which the brake valve device 30 is actuated by the pressure differential generated at the choke devices 31*a*, 31*b* of the pressure divider circuit 31 to open the additional pressure fluid line 6*b* that forms the return side toward the open position 30*b*.

A load holding valve 40 is located in the second pressure fluid line 6*b* that forms the return side upstream of the brake valve device 30. The load holding valve 40 is realized in the form of a seat valve 40*a* that can be operated by means of a pilot control valve 41 which can be actuated toward the open position by the first control signal of the control valve 3.

The pilot control valve 41 is thereby located in a reservoir branch line 42 that runs from a control compression chamber 40*c* of the seat valve 40*a* that acts toward a shutoff position to the reservoir 50 and is realized in the form of a shutoff valve that can be actuated by means of the first control signal of the control valve 3. For this purpose, a control surface of the pilot control valve 41 that acts toward an open position is connected to a control pressure branch line 43 that is in communication with the first control pressure line 8*a*.

When the control valve 3 is actuated toward the position 3*c* by the second control signal, the load holding valve 40 is actuated into the open position by the admission pressure present at the control surface 40*b* of the seat valve acting toward the open position. Thus, pressure fluid can flow from the pump to the piston-rod-side compression chamber 7*b* of the consumer.

When the control valve 3 is actuated toward the position 3*b* by the first control signal, the pilot control valve 41 is actuated by the first control signal into the open position. The control pressure chamber 40*c* of the seat valve 40*a* is discharged toward the reservoir 50 and the seat valve 40*a* is actuated by the return pressure of the consumer into the open position on a control surface 40*d* that acts toward the open position.

The additional pressure fluid line 6*b* that forms the return side can be discharged to the reservoir 50 between the load holding valve 40 and the brake valve device 30 and thus upstream of the brake valve device 30. For this purpose, in the first position 34*a* of the pilot control valve 34, the additional pressure fluid line 6*b* is connected with the reservoir branch line 35. In the second position 34*b* of the pilot control valve 34, the connection of the second pressure fluid line with the reservoir is secured.

To protect the consumer, a pressure limiting device 52 is associated with the pressure fluid line 6*b*. The pressure limiting device 52, which is realized in the form of a pressure limiting valve, is thereby connected to the additional pressure fluid line 6*b* that forms the return side upstream of the load holding valve 40.

The shutoff valve device 20 and the short circuit device 10 as well as the pilot control valve 14 are located together with the brake valve device 30 and its pilot control valve 34 and the load holding valve 40 and its pilot control valve 41 and the pressure limiting device 52 in a valve module 51, which is located directly on the consumer 2, for example on the piston-side compression chamber 7*a*.

In the illustrated neutral position of the control valve 3, by means of the pilot control valve 34 actuated into the first position 34*a*, the additional pressure fluid line 6*b* is discharged to the reservoir 50 between the load holding valve 40 and the brake valve device 30. As a result of which, the control surface 40*b* of the load holding device 40 is also discharged and the load holding valve 40 is actuated into the shutoff position by means of a spring 40*e* located in the control compression chamber 40*c*. As a result of the presence of the load holding valve 40, a shutoff of the second pressure fluid line 6*b* with no fluid leaks can be achieved.

When the control valve 3 is actuated by a first control signal present in the control line 8*a*, the control valve 3 is actuated toward the position 3*b* in which the pressure fluid line 6*a* that is connected with the piston-side compression chamber 7*a* is connected with the discharge line 4 of the pump and thus forms the admission side of the consumer 2. The additional pressure fluid line 6*b* connected with the piston-rod-side compression chamber 7*b* is in communication in the position 3*b* with the reservoir line 5 and thus forms the return side of the consumer 2.

The shutoff valve device 20 is thereby in the shutoff position 20*a*.

In response to the first control signal, the pilot control valve 41 is also actuated by means of the control pressure branch line 43. As a result of which, the control compression chamber 40*c* is discharged and the load holding valve 40 is actuated into the open position by the return pressure present on the control surface 40*d*.

Simultaneously, the pilot control valve 34 is actuated into the second position 34*b* by means of the control pressure branch line 37. As a result of which, the brake valve 30 is actuated toward the open position 30*b* by the pressure differential generated by the pressure divider circuit 31.

In addition, the pilot control valve 14 is actuated by means of the control pressure branch line 15 into the second position 14*b*. As a result of which, the short circuit valve 11 is actuated toward the shutoff position by the admission pressure present in the pressure fluid line 6*a*. The control surface 11*a* of the short circuit valve 11 is in communication with the additional pressure fluid line 6*b* and thus with the return side. If the return pressure in the additional pressure fluid line 6*b* present at the control surface 11*a* thereby exceeds the admission pressure present on the control surface 11*b*, the short circuit valve 11 is actuated into the open position. As a result of which, for the regeneration function, all the pressure fluid can flow out of the additional pressure fluid line 6*b* that forms the return side via the connecting line 12 into the pressure fluid line 6*a* that forms the admission side. All of the pressure fluid that flows out of the return side of the consumer can thereby be fed to the admission side. As a result of which, on the admission side of the consumer 2, in addition to the discharge flow delivered by the pump, the entire flow of pressure fluid that flows out on the return side is available to increase the speed of movement of the consumer and to prevent cavitation on the admission side, and the speed of movement of the consumer can thus be doubled in the regeneration function. The regeneration function thereby has short flow paths, as a result of which the line losses are low and regeneration can be achieved with high efficiency.

When the control valve 3 is actuated toward the position 3*b* by the first control signal, the regeneration function is active, so that the start of movement of the consumer occurs with the regeneration function. A jerking movement as the result of an uncontrolled activation of the regeneration function at the start of the movement of the consumer is thereby effectively prevented.

If the admission pressure in the pressure fluid line 6*a* that forms the admission side and is transmitted by means of the branch line 24 to the electronic control device 22 exceeds a specified threshold, the shutoff valve device 20 is actuated into the open position 20*b* by means of the electronic control device 22. As a result of which, the second pressure fluid line 6*b* that forms the return side of the consumer is brought into communication via the control valve 3 with the reservoir. The control surface 11*a* of the short circuit device 10 is thereby likewise discharged to the reservoir. As a result of which, the short circuit device 10 is actuated into the shutoff position by the admission pressure present at the control surface 11*b* which is transmitted by means of the shuttle valve device 16 to the second control surface 11*b*, and thus the regeneration function is terminated. As a result, the regeneration function can be overridden in a simple manner as a function of the admission pressure present on the admission side of the consumer 2. The regeneration function can thus be overridden and deactivated in operating conditions in which high admission pressures are required at the admission side of the consumer 2, for example when high digging forces are required on the stick of the excavator actuated by the consumer.

When the control valve 3 is actuated toward the position 3*c*, the shutoff valve device 20 is actuated by means of the electronic control device 22 into the open position 20*b*. The pilot control valve 14 is in the first position 14*a*. As a result of which, the short circuit valve 11 is actuated into the closed position by the admission pressure present at the control surface 11*b* in the additional pressure fluid line 6*b*. The brake valve device 30 is in the shutoff position 30*a*, whereby pressure fluid can flow to the load holding valve 40 via the shutoff valve 30*d* which is located in the shutoff position 30*a* of the brake valve device 30. The load holding valve 40 is actuated into the open position by the admission pressure present at the control surface 40*b*. Pressure fluid can thus flow from the pump to the piston-rod-side compression chamber 7*b* of the consumer. The piston-side compression chamber 7*a* of the consumer 2 is in communication with the reservoir via the pressure fluid line 6*a* and the control valve 3 actuated toward the position 3*c*.

Instead of the actuation of the shutoff valve device 20 by means of an electronic control device 22, it is also possible to actuate the shutoff valve 20 hydraulically as a function of the control signals of the control valve 3 present in the control pressure branch lines 23, 25 and the admission pressure of the consumer 2 present in the branch line 24.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A control valve device for the control of a dual-action consumer, comprising:

a control valve that controls a connection of a pressure fluid line that forms an admission side of a consumer with a pump and controls a connection of an additional pressure fluid line that forms a return side of the consumer with a reservoir;

a regeneration function by means of which the return side of the consumer can be connected with the admission side of the consumer, wherein the regeneration function comprises a short circuit device located between the consumer and the control valve and provides a connection of the additional pressure fluid line that forms the return side of the consumer with the pressure fluid line that forms the admission side of the consumer; and a shutoff valve device located between the consumer and the control valve to block the connection of the additional pressure fluid line that forms the return side of the consumer with the reservoir, the shutoff valve device comprising a shutoff control valve with a shutoff position and an open position, wherein in response to a first control signal of the control valve that actuates the control valve toward a position that connects the pressure fluid line with the pump and connects the additional pressure line with the reservoir, the shutoff valve device is actuated into the shutoff position and can be actuated toward the open position as a function of an admission pressure present at the pressure fluid line that forms the admission side of the consumer, and wherein the short circuit device comprises a short circuit valve located in a connecting line that connects the additional pressure fluid line with the pressure fluid line and has a shutoff position and an open position and, for the regeneration function, can be actuated toward the open position as a function of the first control signal of the control valve.

2. The control valve device as recited in claim 1, wherein the shutoff valve device can be actuated toward the open position by a second control signal of the control valve which actuates the control valve toward a position that connects the additional pressure fluid line with the pump and connects the pressure fluid line with the reservoir.

3. The control valve device as recited in claim 1, wherein the shutoff valve device can be actuated toward the shutoff position by a spring.

4. The control valve device as recited in claim 1, wherein the short circuit valve comprises a spring-loaded seat valve having a first control pressure surface that acts toward an open position and can be actuated by the pressure present in the additional pressure fluid line.

5. The control valve device as recited in claim 4, wherein the short circuit valve includes a second control surface that acts toward a shutoff position, which can be actuated by the pressure present in the additional pressure fluid line and, for the regeneration function, can be discharged by the pressure present in the additional pressure fluid line.

6. The control Valve device as recited in claim 5, including a pilot control valve for control of the actuation of the second control pressure surface.

7. The control valve device as recited in claim 6, wherein the pilot control valve has a first position in which the second control pressure surface is in communication with the additional pressure fluid line, and a second position in which the second control pressure surface is in communication with the pressure fluid line, and wherein the pilot control valve can be actuated as a function of the first control signal of the control valve toward the second position.

8. The control valve device as recited in claim 7, wherein the pilot control valve can be actuated by a spring toward the first position.

9. The control valve device as recited in claim 5, wherein the second control pressure surface can be actuated by the pressure present in the pressure fluid line.

10. The control valve device as recited in claim 9, wherein between the pilot control valve and the second control pressure surface, a shuffle valve device is located, and wherein a first input of the shuffle valve device is in communication with the output of the pilot control valve, a second input of the shuttle valve device is in communication with the pressure fluid line, and an output of the shuffle valve device is in communication with the second control pressure surface.

11. The control valve device as recited in claim 1, wherein the consumer is a stick cylinder of an excavator.

12. A control valve device for the control of a dual-action consumer, comprising:

a control valve that controls a connection of a pressure fluid line that forms an admission side of a consumer with a pump and controls a connection of an additional pressure fluid line that forms a return side of the consumer with a reservoir;

a regeneration function by means of which the return side of the consumer can be connected with the admission side of the consumer, wherein the regeneration function comprises a short circuit device located between the consumer and the control valve and provides a connection of the additional pressure fluid line that forms the return side of the consumer with the pressure fluid line that forms the admission side of the consumer;

a shutoff valve device located between the consumer and the control valve to block the connection of the additional pressure fluid line that forms the return side of the consumer with the reservoir; and a brake valve device associated with the additional pressure fluid line that forms the return side of the consumer and upstream of the short circuit device.

13. The control valve device as recited in claim 12, wherein the brake valve device has a shutoff position and an open position, and wherein a pressure divider circuit that is in communication with the pressure fluid line is provided for the control of the brake valve device.

14. The control valve device as recited in claim 13, wherein the pressure divider circuit has a control pressure line that leads to a control surface of the brake valve device that acts toward the open position and is in communication with the pressure fluid line, wherein a choke device is located in the control pressure line and an additional control pressure line is connected to the control pressure line downstream of the choke device, wherein the additional control pressure line leads to a control surface of the brake valve device that acts toward the shutoff position, and wherein an additional choke device is located in the additional control pressure line.

15. The control valve device as recited in claim 14, wherein a pilot valve is provided for control of the pressure divider circuit, by means of which a connection of the additional control pressure line with a reservoir can be controlled.

16. The control valve device as recited in claim 15, wherein the pilot control valve has a first position in which the connection of the additional control pressure line to the reservoir is shut off and a second position in which the additional control pressure line is connected with the reservoir, and wherein the pilot control valve can be actuated toward the second position by the first control signal of the control valve.

17. The control valve device as recited in claim 15, wherein the pilot control valve can be actuated toward the first position by a spring.

18. The control valve device as recited in claim 12, including a load holding valve associated with the pressure fluid line that forms the return side of the consumer, the load holding valve positioned upstream of the brake valve device.

19. The control valve device as recited in claim 18, wherein the load holding valve comprises a pilot-operated seat valve that can be operated by a pilot control valve, which seat valve can be actuated toward an open position as a function of the first control signal of the control valve.

20. The control valve device as recited in claim 16, wherein in the first position of the pilot control valve of the pressure divider circuit the additional pressure fluid line that forms the return side of the consumer is discharged upstream of the brake valve device to the reservoir.

21. The control valve device as recited in claim 16, wherein in the second position of the pilot control valve of the pressure divider circuit the connection of the additional pressure fluid line that forms the return side of the consumer with the reservoir is shut off.

22. The control valve device as recited in claim 18, including a pressure limiting device for protection of the additional pressure fluid line that forms the return side of the consumer, wherein the pressure limiting device is located upstream of the load holding valve in the additional pressure fluid line that forms the return side of the consumer.

23. The control valve device as recited in claim 13, wherein the short circuit device and/or a pilot control valve of the short circuit device and/or the brake valve device and/or a pilot control valve of the pressure divider circuit and/or a load holding valve and/or a pressure limiting device and/or the shutoff valve device is/are connected to the pressure fluid line of the consumer.

* * * * *

UNITED STATES PATENT AND TRADEMARK OFFICE

CERTIFICATE OF CORRECTION

PATENT NO. : 7,540,231 B2
APPLICATION NO. : 11/637235
DATED : June 2, 2009
INVENTOR(S) : Hoffman et al.

It is certified that error appears in the above-identified patent and that said Letters Patent is hereby corrected as shown below:

Title page, Item (56) add

-- 4,509,405 4/1985 Bates --

Signed and Sealed this

Eleventh Day of May, 2010

David J. Kappos

David J. Kappos
*Director of the United States Patent and Trademark Office*